US005745826A

United States Patent [19]

Chang et al.

[11] Patent Number: 5,745,826

[45] Date of Patent: Apr. 28, 1998

[54] LIQUID TONER IMAGE CONDITIONING ROLL HAVING IMAGE PROTECTION SURFACE LAYER

[75] Inventors: Shu Chang, Webster; Lawrence Floyd, Jr., Rochester; Santokh S. Badesha, Pittsford; Donald S. Sypula, Penfield; John F. Knapp, Fairport, all of N.Y.

[73] Assignee: Xerox Corporation, Stamford, Conn.

[21] Appl. No.: 785,108

[22] Filed: Jan. 21, 1997

[51] Int. Cl.[6] ..... G03G 15/10

[52] U.S. Cl. ..... 399/237

[58] Field of Search ..... 399/296, 237, 399/249, 239, 348, 233; 430/119, 125, 117; 492/17, 35

[56] References Cited

U.S. PATENT DOCUMENTS

| | | | |
|---|---|---|---|
| 3,757,398 | 9/1973 | Urban | 492/35 X |
| 4,286,039 | 8/1981 | Landa et al. | 430/119 |
| 4,392,742 | 7/1983 | Landa | 399/348 |
| 4,985,733 | 1/1991 | Kurotori et al. | 399/156 |
| 5,136,334 | 8/1992 | Camis et al. | 399/233 |
| 5,332,642 | 7/1994 | Simms et al. | 430/125 |
| 5,424,813 | 6/1995 | Schlueter, Jr. et al. | 399/239 |
| 5,559,588 | 9/1996 | Larson et al. | 399/240 |
| 5,640,655 | 6/1997 | Shoji | 399/249 |

*Primary Examiner*—S. Lee
*Attorney, Agent, or Firm*—Tallam Nguti

[57] ABSTRACT

An image protecting conditioning roll for conditioning developed images in a liquid immersion development reproduction machine. The image protecting conditioning roll includes a rigid, conductive and porous core; an absorbent intermediate layer formed over the rigid core; and an inelastic image protecting top, outer layer formed over the absorbent intermediate layer, for contacting and protecting an image being conditioned, by preventing undesirable image offset and image smearing.

8 Claims, 2 Drawing Sheets

LIQUID TONER IMAGE CONDITIONING ROLL HAVING IMAGE PROTECTION SURFACE LAYER

BACKGROUND OF THE INVENTION

This invention relates to liquid immersion development (LID) reproduction machines, and more particularly to an image conditioning roll having an image protecting surface layer for producing high quality conditioned images in such a machine.

Liquid electrophotographic reproduction machines are well known, and generally each includes an image bearing member or photoreceptor having an image bearing surface on which latent images are formed and developed as single color or multiple color toner images for eventual transfer to a receiver substrate or copy sheet. Each such reproduction machine thus includes a development system or systems that each utilizes a liquid developer material typically having about 2 percent by weight of charged, solid particulate toner material of a particular color, that is dispersed at a desired concentration in a clear liquid carrier.

In the electrophotographic process of such a machine, the latent images formed on the image bearing surface of the image bearing member or photoreceptor are developed with the charged toner particles creating low solids liquid toner images, with some excess liquid carrier being left behind or removed, yielding high solids images typically each containing about 12 percent by weight of the toner particles. The developed image or images on the image bearing member are then further conditioned and subsequently electrostatically transferred from the image bearing surface to an intermediate transfer member. Following that, the image or images are again conditioned and then hot or heat transferred from the intermediate transfer member, at a heated transfer or transfix nip, to an output image receiver substrate or copy sheet.

Conditioning of liquid developer images as above methods must be achieved without disturbing each toner image, and in such a manner as to prevent toner particles from entering the carrier liquid removal device. In particular, the image must be conditioned uniformly without the conditioning device leaving undesirable outlines or footprints of the conditioning device in the conditioned image and in the case of a perforated roller without appearance differences between pore and non-pore contacted areas of the image.

In a color LID machine, low solids image conditioning typically utilizes four blotting devices such as four identical blotter rolls that each function to densify an initially developed liquid toner image from a low solids content of about a 5 percent solid toner particles content (by weight) to about a 20–25 percent such content. Low solids conditioning as such is needed to enable subsequent effective transfer of the liquid toner image from the photoreceptor belt or image bearing member to an intermediate belt where high solids content conditioning then takes place. High solids content conditioning utilizes a single blotting device to additionally remove fluid or carrier liquid from the about 20–25 percent solids content (by weight) toner image transferred to the intermediate, to yield a high solids image that is about 50–75 percent solids content (by weight). Blotter device characteristic (e.g. core rigidity and porosity) requirements are therefore reasonably different for quality conditioning of low versus high solids content LID images.

Conventionally, blotter rolls typically each include a rigid cylindrical core that has perforations therethrough, a conformable absorbent layer over the rigid core, and an outer layer or skin over the conformable layer. Ordinarily, the outer layer or skin has to be elastic in order to move or flow with the conformable layer. However, it has been found that such an elastic outer layer can exhibit significant creep during use, and over time. As such, larger than pore size toner particles can become trapped within stretched and recontracted elastic pores thereof, thus plugging such pores and reducing the life of the conditioning roll. Additionally, the initial size of its pores can become larger, thus resulting in the top layer acting as a poor seal against the blotting assist vacuum applied to the core of the blotting or conditioning roll, as well as in undesirable reduced surface energies and increased image offset to the conditioning roll. The final result often is less than desirable quality conditioned images.

The following references may be relevant to various aspects of the present invention. For example, U.S. Pat. No. 4,286,039 issued Aug. 25, 1991, to Landa et al. discloses an image forming apparatus comprising a deformable polyurethane roller, which may be a squeegee roller or blotting, that is, conditioning roller which is biased by a potential having a sign the same as the sign of the charged toner particles in a liquid developer.

U.S. Pat. No. 4,985,733 issued Jan. 15, 1991, to Kurotori et. al. discloses a liquid toner copying machine including a non-thermal image conditioning apparatus comprising an elastic blotter or conditioning roll and an elastic backup roller for bringing a liquid toner image carrying sheet into contact with the blotter roll.

U.S. Pat. No. 5,136,334 issued Aug. 4, 1992, to Camis et. al. discloses a liquid toner image conditioning apparatus including a heated inner core connected to a source of AC or DC bias, and having a smooth outer surface made of a soft elastomeric material.

U.S. Pat. No. 5,332,642, issued Jul. 26, 1994, to Simms et al. having a common assignee as the present application, discloses a porous roller for increasing the solids content of an image formed from a liquid developer. The liquid dispersant absorbed through the roller is vacuumed out through a central cavity of the roller. The roller core and/or the absorbent material formed around the core may be biased with the same charge as the toner so that the toner is repelled from the roller while the dispersant is absorbed.

SUMMARY OF THE INVENTION

In accordance with the present invention, there is provided an image protecting and conditioning roll for conditioning developed images in a liquid immersion development reproduction machine. The image protecting conditioning roll includes a rigid, conductive and porous core; an absorbent intermediate layer formed over the rigid core; and an inelastic image protecting top, outer layer formed over the absorbent intermediate layer for contacting and protecting an image being conditioned, by preventing undesirable image offset and image smearing.

BRIEF DESCRIPTION OF THE DRAWINGS

Other aspects of the present invention will become apparent as the following description proceeds and upon reference to the drawings, in which.

DETAILED DESCRIPTION OF THE INVENTION

Figure 1:
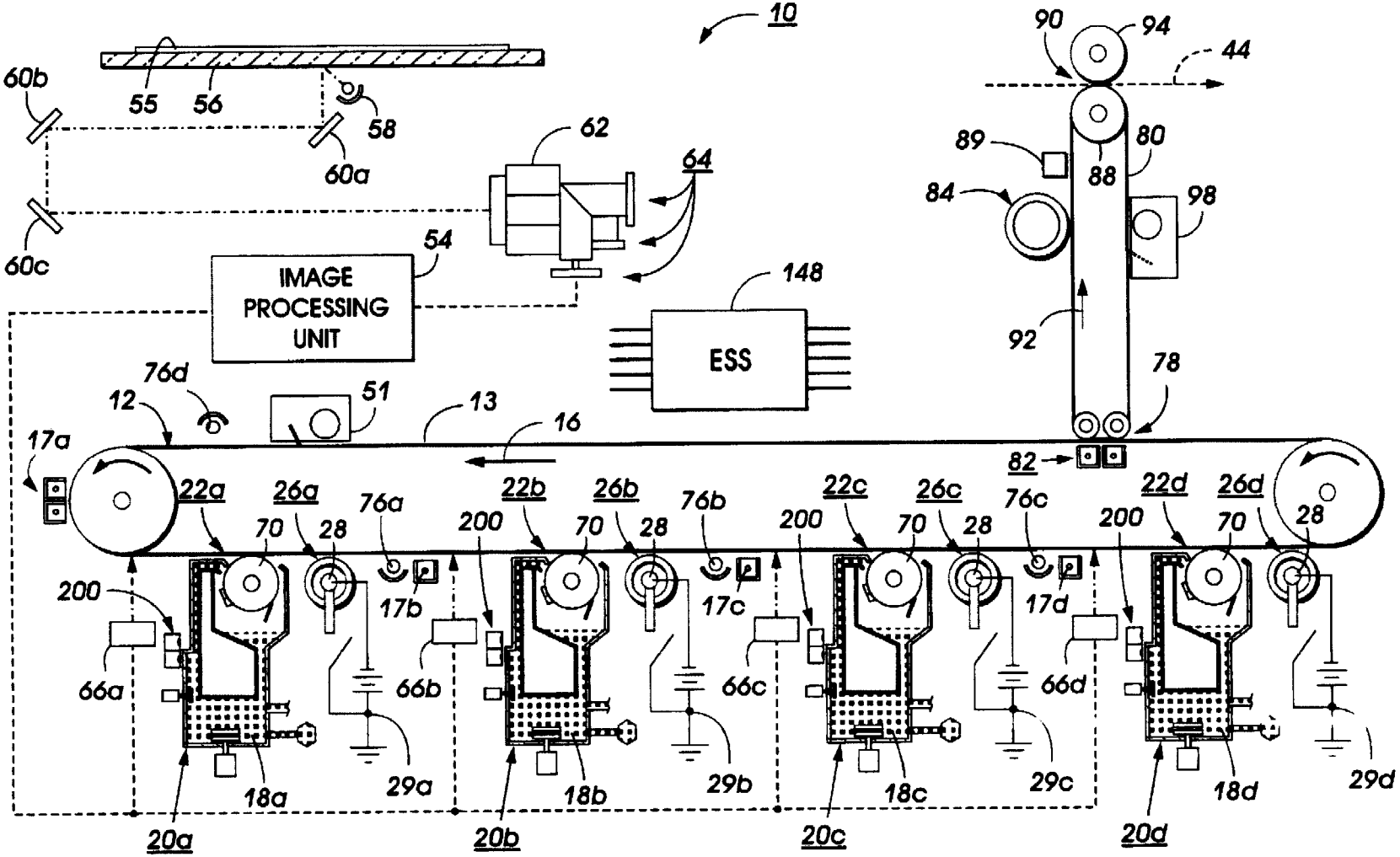
FIG. 1 is a vertical schematic of an exemplary color electrophotographic liquid immersion development (LID) reproduction machine incorporating an image protecting conditioning roll in accordance with the present invention.

For a general understanding of the features of the present invention, reference numerals have been used throughout to designate identical elements. It will become evident from the following discussion that the present invention is equally well suited for use in a wide variety of reproduction machines and is not necessarily limited in its application to the particular embodiment depicted herein.

Inasmuch as the art of electrophotographic reproduction is well known, the various processing stations employed in the FIGS. 1 and 2 of the reproduction machine will be shown hereinafter only schematically, and their operation described only briefly.

Referring now to FIG. 1, there is shown a color electrophotographic reproduction machine 10 incorporating a development system including the sintered metal fiber blotter roll device of the present invention. Although a multiple color LID machine is illustrated, it is understood that the invention is equally suitable for a single color LID machine. The color copy process of the machine 10 can begin by either inputting a computer generated color image into an image processing unit 54 or by way of example, placing a color document 55 to be copied on the surface of a transparent platen 56. A scanning assembly consisting of a halogen or tungsten lamp 58 which is used as a light source, and the light from it is exposed onto the color document 55. The light reflected from the color document 55 is reflected, for example, by a 1st, 2nd, and 3rd mirrors **60*a*, 60*b* and 60*c*, respectively through a set of lenses (not shown) and through a dichroic prism 62 to three charged-coupled devices (CCDs) 64** where the information is read.

The reflected light is separated into the three primary colors by the dichroic prism 62 and the CCDs 64. Each CCD 64 outputs an analog voltage which is proportional to the intensity of the incident light. The analog signal from each CCD 64 is converted into an 8-bit digital signal for each pixel (picture element) by an analog/digital converter (not shown). Each digital signal enters an image processing unit 54. The digital signals which represent the blue, green, and red density signals are converted in the image processing unit 54 into four bitmaps: yellow (Y), cyan (C), magenta (M), and black (Bk). The bitmap represents the value of exposure for each pixel, the color components as well as the color separation. Image processing unit 54 may contain a shading correction unit, an undercolor removal unit (UCR), a masking unit, a dithering unit, a gray level processing unit, and other imaging processing sub-systems known in the art. The image processing unit 54 can store bitmap information for subsequent images or can operate in a real time mode.

The machine 10 includes a photoconductive imaging member or photoconductive belt 12 which is typically multilayered and has a substrate, a conductive layer, an optional adhesive layer, an optional hole blocking layer, a charge generating layer, a charge transport layer, a photoconductive or image forming surface 13, and, in some embodiments, an anti-curl backing layer. As shown, belt 12 is movable in the direction of arrow 16. The moving belt 12 is first charged by a charging unit **17*a*. A raster output scanner (ROS) device 66*a*, controlled by image processing unit 54, then writes a first complementary color image bitmap information by selectively erasing charges on the charged belt 12. The ROS 66*a*** writes the image information pixel by pixel in a line screen registration mode. It should be noted that either discharged area development (DAD) can be employed in which discharged portions are developed or charged area development (CAD) can be employed in which the charged portions are developed with toner.

Figure 2:
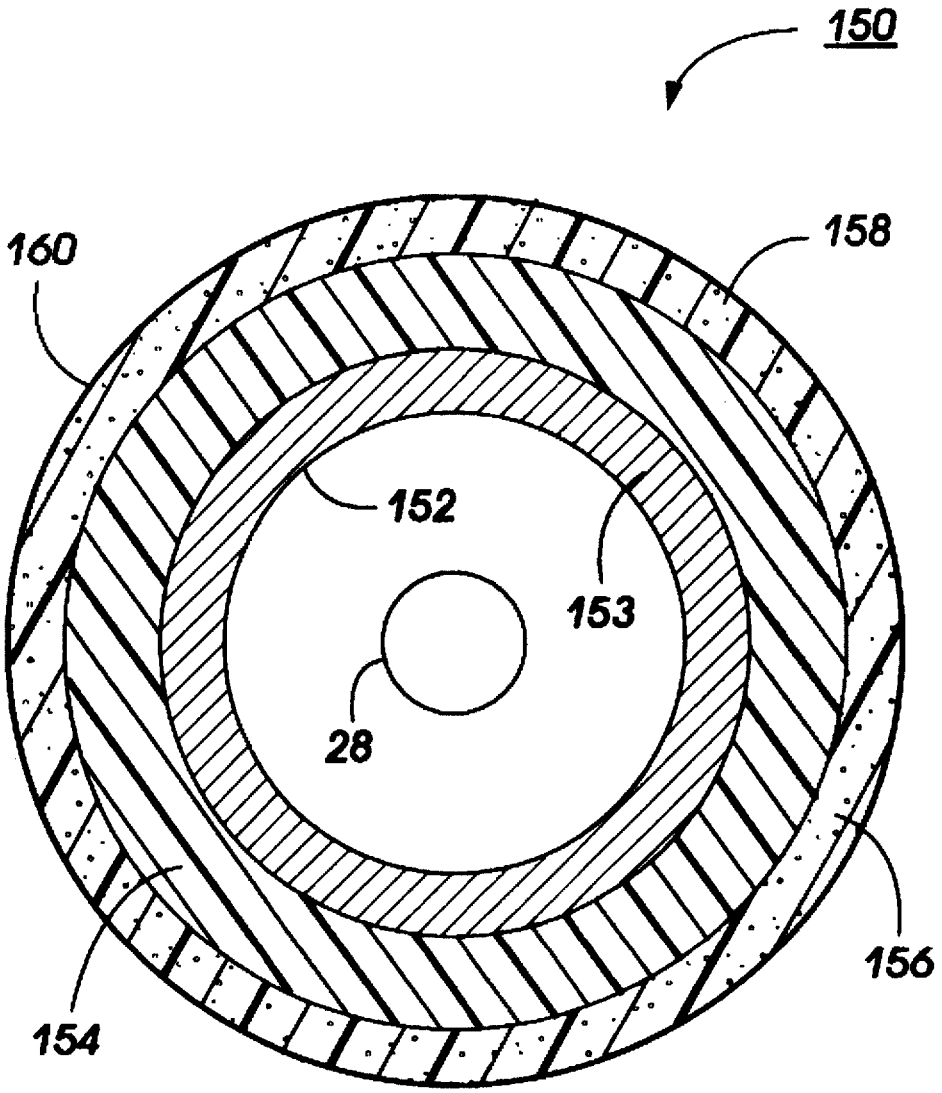
FIG. 2 is an end section of the image protecting conditioning roll of the present invention.

Referring now to FIGS. 1 and 2, after the electrostatic latent image has been recorded thus, belt 12 advances it to a first development station **20*a*. Like subsequent development stations 20*b*, 20*c*, and 20*d*, the development station 20*a* includes a housing 21 defining a mixing chamber 23, a developer material delivery conduit 25, a development roller 70, and a spent developer material recovery chamber 27. The development roller 70, rotating in the direction as shown, advances a quantity of liquid developer material 18*a*, preferably black toner developer material containing charged black toner particles at a desired concentration, delivered to the roller 70 via the conduit 25, into a development zone or nip 22*a*. An electrode 24*a* positioned before the entrance to development zone or nip 22*a* is electrically biased to generate an AC field just prior to the entrance to development zone or nip 22*a* so as to disperse the toner particles substantially uniformly throughout the liquid carrier. The toner particles, disseminated at the desired concentration through the liquid carrier, pass by electrophoresis to the electrostatic latent image forming a first liquid color separation developed image. As is well known, the charge of the toner particles is opposite in polarity to the charge on the photoconductive or image forming surface 13**.

After the first liquid color separation image is developed, for example, with black liquid toner, it is yet a low solids content image, and it is then conditioned by the image protecting conditioning roll **26*a*, which is the same as subsequent identical rolls 26*b*, 26*c*, 26*d*, made in accordance with the present invention (to be described in detail below). The roll 26*a*, 26*b*, 26*c*, 26*d* as mounted contacts the low solids image on belt 12 and conditions it by compacting the toner particles that form it, and by reducing the fluid content of the image (thus increasing its percent solids resulting in a high solids content image) while inhibiting the departure of toner particles from the image. Preferably, the percent solids content achieved in the high solids image is more than 20 percent by weight. A vacuum device 28 located on one end of the roll 26*a*, 26*b*, 26*c*, 26*d*, applies a blotting assist vacuum thereto and draws liquid that has permeated into the roll, out through such end. Vacuum device 28** deposits the liquid in a receptacle or some other location for either disposal or recirculation as liquid carrier.

In operation, the roll **26*a*, 26*b*, 26*c*, 26*d* rotates in a direction as shown with desired contact against the low solids image on belt 12. The porous image protecting outer layer of roll 26*a*, 26*b*, 26*c*, and 26*d*, in accordance to the present invention, advantageously protects the image being conditioned by preventing undesirable image offset and image smearing as the roll gently and effectively compacts the low solids image. The low solids conditioned image on belt 12 is then advanced to lamp 76*a* which floods the surface 13 with light for erasing residual charge left on the surface 13**.

As shown, according to the REaD (i.e. Recharge, Expose and Develop) process of the machine 10, the developed latent image on belt 12 is subsequently recharged with charging unit **17*b*, and is next re-exposed by ROS 66*b*. ROS 66*b*** superimposing a second color image bitmap information over the previous developed latent image. Preferably, for each subsequent exposure an adaptive exposure processor is employed that modulates the exposure level of the raster output scanner (ROS) for a given pixel as a function of toner previously developed at the pixel site, thereby allowing toner layers to be made independent of each other. Also, during subsequent exposure, the image is re-exposed in a line screen registration oriented along the process or slow scan direction. This orientation reduces motion quality errors and allows the utilization of near perfect transverse registration.

At the second development station 20*b*, a development roller 70, rotating in the direction as shown, advances a liquid developer material 18*b*, containing toner particles of a second color, e.g. cyan, at a desired toner concentration, from the delivery conduit 25, to a second development zone or nip 22*b*. An electrode 24*b* positioned before the entrance to development zone or nip 22*b* is electrically biased to generate an AC field just prior to the entrance to development zone or nip 22*b* so as to disperse the toner particles substantially uniformly throughout the liquid carrier. The toner particles, disseminated through the liquid carrier, pas by electrophoresis to the previous developed image to develop a second low solids color separation image thereon.

The second low solids conditioning roll 26*b* contacts the low solids image on belt 12 and conditions it similarly by sufficiently compacting the toner particles forming it, and reducing its fluid content, while preventing image offset and smearing. Preferably, the percent solids achieved is more than 20 percent, however, the percent of solids can range between 15 percent and 40 percent. The conditioned images on belt 12 are then advanced to lamp 76*b* where any residual charge left on the photoconductive surface is erased by flooding it with light.

To similarly produce the third color separation image using the third toner color, for example magenta color toner, the developed images on moving belt 12 are recharged with charging unit 17*c*, and re-exposed by a ROS 66*c*, which superimposes a third color image bitmap information over the previous developed latent image. At the third development station 20*c* a development roller 70, rotating in the direction as shown, advances a magenta liquid developer material 18*c*, containing toner particles at a desired toner concentration, from the delivery conduit 25, to a third development zone or nip 22*c*. An electrode 24*c* positioned before the entrance to development zone or nip 22*c* is electrically biased to generate an AC field just prior to the entrance to development zone or nip 22*c* so as to disperse the toner particles substantially uniformly throughout the liquid carrier. The toner particles, disseminated through the liquid carrier, pass by electrophoresis to the previous developed image.

A third conditioning roll 26*c*, in accordance with the present invention, contacts the developed low solids image on belt 12 and conditions the image by compacting it, thus reducing its fluid content so that the images have a percent solids within a range between 15 percent and 40 percent. The images or composite image on belt 12 are then advanced to lamp 76*c* where any residual charge left on the photoconductive surface of belt 12 is erased by flooding the photoconductive surface with light from the lamp.

Finally, to similarly produce the fourth color separation image using the fourth toner color, for example yellow color toner, the developed images on moving belt 12 are recharged with charging unit 17*d*, and re-exposed by a ROS 66*d*. ROS 66*d* superimposes a fourth color image bitmap information over the previous developed latent images. At the fourth development station 20*d* development roller 70, rotating in the direction as shown, advances a yellow liquid developer material 18*d*, containing toner particles at a desired toner concentration, from the delivery conduit 25, to a fourth development zone or nip 22*d*. An electrode 24*d* positioned before the entrance to development zone or nip 22*d* is electrically biased to generate an AC field just prior to the entrance to development zone or nip 22*d* so as to disperse the toner particles substantially uniformly throughout the liquid carrier. The toner particles, disseminated through the liquid carrier, pass by electrophoresis to the previous developed image.

A fourth conditioning roll 26*d*, in accordance with the present invention, contacts the developed images on belt 12 and conditions them by reducing fluid their content so that the images have a percent solids within a range between 15 percent and 40 percent. It should be evident to one skilled in the art that the color of toner at each development station could be in a different arrangement.

The resultant composite multicolor image, a high solids multi layer image by virtue of low image conditioning, is then advanced to an intermediate transfer station 78. At the transfer station 78, the multicolor image is electrostatically transferred to an intermediate member 80 with the aid of a charging roll 82. Intermediate member 80 may be either a rigid roll or an endless belt, as shown, having a path defined by a plurality of rollers in contact with the inner surface thereof.

In accordance with an important aspect of the present invention, high solids image conditioning of the high solids multicolor image on the intermediate transfer member 80 is also achieved by means of a image protecting conditioning roll 84 in accordance with the present invention. The image protecting conditioning roll 84 is adapted to condition the image as such, so that the multilayer, multicolor image thereafter has a toner solids content of more than 50 percent (by weight).

Subsequently, the reconditioned image on the surface of the intermediate member 80 is advanced through a liquefaction stage before being transferred within a second transfer nip 90 to an image recording sheet 44. Within the liquefaction stage, particles of toner forming the transferred image are transformed by a heat source 89 into a tackified or molten state. The heat source 89 can also be applied to member 80 internally. The intermediate member 80 then continues to advance in the direction of arrow 92 until the tackified toner particles reach the transfer nip 90.

The transfer nip 90 is more specifically a transfixing nip, where the multicolor image is not only transferred to the recording sheet 44, but it is also fused or fixed by the application of appropriate heat and pressure. At transfix nip 90, the liquefied toner particles are forced, by a normal force applied through a backup pressure roll 94, into contact with the surface of recording sheet 44. Moreover, recording sheet 44 may have a previously transferred toner image present on a surface thereof as the result of a prior imaging operation, i.e. duplexing. The normal force, produces a nip pressure which is preferably about 20 psi, and may also be applied to the recording sheet via a resilient blade or similar spring-like member uniformly biased against the outer surface of the intermediate member across its width.

As the recording sheet 44 passes through the transfix nip 90 the tackified toner particles wet the surface of the recording sheet, and due to greater attractive forces between the paper and the tackified particles, as compared to the attraction between the tackified particles and a liquid-phobic surface of member 80, the tackified particles are completely transferred to the recording sheet. As shown, the surface of the intermediate transfer belt 80 is thereafter cleaned by a cleaning roll 98 prior to receiving another toner image from the belt 12.

Invariably, after the multicolor image was transferred from the belt 12 to intermediate member 80, residual liquid developer material remained adhering to the photoconductive surface of belt 12. A cleaning roll 51 including a roller formed of any appropriate synthetic resin, is therefore provided as shown and driven in a direction opposite to the direction of movement of belt 12 to scrub the photoconductive surface clean. It is understood, however, that a number of photoconductor cleaning means exist in the art, any of which would be suitable for use with the present invention. Any residual charge left on the photoconductive surface after such cleaning is erased by flooding the photoconductive surface with light from a lamp **76*d* prior to again charging the belt 12** for producing another multicolor image as above.

As illustrated the reproduction machine 10 further includes an electronic control subsystem (ESS) shown as 148 for controlling various components and operating subsystems of the reproduction machine. ESS 148 thus may be a self-contained, dedicated minicomputer, and may include at least one, and may be several programmable microprocessors for handling all the control data including control signals from control sensors for the various controllable aspects of the machine.

Referring now to FIGS. 1 and 2, the image protecting conditioning rolls **26*a*, 26*b*, 26*c*, 26*d*, and 84 of the present invention are illustrated as a single image protecting conditioning roll 150. As shown, the roll 150 includes a rigid core 152 that is made of a conductive material, and has pores 153 therethrough. The roll 150 also includes a conductive, open cell absorbent foam layer 154 that is formed over the rigid core 152. Importantly, in accordance with the present invention, the roll 150 includes an inelastic, image protecting top, outer layer 156 that is formed over the absorbent layer 154** for contacting and conditioning an image, without undesirable image offset and smearing.

Preferably, the inelastic, image protecting top, outer layer 156 is made of an inelastic nonconductive thermoplastic material, that is, a thermoplastic material that is not elastic at room temperature. Examples of such inelastic materials for the top, outer layer 156 are polyvinylcloride (PVC); polyethylene (PE); polycarbonates (PC); polystyrenes (PS); fluorinated thermoplastic copolymers such as, polyvinylclorine, fluoride, hexafluoroethylene, tetrafluoroethyl, and perfluoroalkoxy polymer (PFA); the TEFLON (Registered Trademark) family of thermoplastic materials; and the NYLON (Registered Trademark) family of materials such as polyamides and polyimides.

The inelastic top, outer layer 156 can also be made of a nonconductive mesh of woven or non-woven polymer fibers. In such a case, the base material of the fibers can be elastic, however, the fiber cladding material and the physical properties of the final mesh preferably should be inelastic in accordance with the present invention.

Regardless of the particular inelastic material used, the top, outer layer 156 of the present invention preferable should have a large number of relatively small, and uniform size pores 158 per unit surface area, and hence a relatively high porosity. The particular size of such pores can be controllably selected, given the range in size of the particles of toner forming the liquid toner image being conditioned. Preferably too, the outer surface 160 of the layer 156 is relatively very smooth, owing to the relatively small size and large number of the pores 158. Plugging of the pores can initially be prevented by selecting a relatively small uniform size for each of the pores 158 that is smaller than the low end of the range of toner particle sizes. Any decrease in fluid removal rate due to the smallness of the pore sizes is compensated for by having the layer include a large number of such pores 158, in other words, a layer having a large or high porosity.

To re-emphasize, selecting a relatively small uniform size for each of the pores 158 advantageously results in a relatively smooth surface and in relatively high surface energies. Such a smooth surface, and such surface energies function together to decrease any tendency, of the liquid toner image being conditioned, to adhere or offset to such surface of the image protecting conditioning roll 150. As such, the primary advantages of the inelastic top, outer layer 156 of the roll 150, when compared to similar rolls having elastic outer layers, is that the inelastic layer does a better job in protecting the image being conditioned, from undesirable image offset and image smearing. In addition, by being nonconductive, the inelastic top, outer layer 156 of the present invention also acts to prevent potential electrical shortening occurring between the biased conditioning roll 150 and the image bearing member 12.

As can be seen, there has been provided, an image protecting conditioning roll having an inelastic top layer. The inelastic top layer has a large number of relatively small pores, and hence a relatively smooth surface with high surface energy, which advantageously function to protect the toner particle image by preventing larger-than pore size toner particles from plugging its pores, as well as, by preventing undesirable liquid toner image offset to such surface. Additionally, the inelastic top layer as such also acts to protect the image being conditioned by generating a vacuum-seal against the blotting assist vacuum applied to the core of the conditioning roll, and by preventing image smear due to lack of creeping of the inelastic material forming the layer. The smallness of the pore sizes advantageously functions to increase the capillarity of the inelastic layer.

While the invention has been described with reference to particular preferred embodiments, the invention is not limited to the specific examples shown, and other embodiments and modifications can be made by those skilled in the art without depending from the spirit and scope of the invention and claims.

What is claimed is:

1. A liquid immersion development (LID) reproduction machine comprising:

(a) a movable image forming member having an image forming surface defining a path of movement of said image forming member;

(b) means mounted along said path of movement for forming a latent image onto said image forming surface;

(c) development means mounted along said path of movement and containing liquid developer material consisting of a clear liquid carrier and solid charged toner particles at a desired concentration level for developing the latent image to create a visible low solids content liquid toner image;

(d) an intermediate transfer member mounted along said path of movement, downstream of said development means and into contact with said image forming surface for receiving a high solids content liquid toner image from said image forming surface; and (e) an image protecting conditioning roll mounted along said path of movement downstream of said development means for conditioning the liquid toner image, said image protecting conditioning roll including:

(i) a rigid porous core;

(ii) an absorbent layer formed over said rigid porous core; and (iii) an inelastic image protecting top outer layer formed over said absorbent layer for contacting and protecting an image being conditioned, by preventing undesirable offset and smearing of such image being conditioned.

2. The image protecting conditioning roll of claim 1, wherein said inelastic image protecting top outer layer is made of a nonconductive mesh of polymer fibers each having a base material and an inelastic cladding material.

3. The image protecting conditioning roll of claim 2, wherein said inelastic image protecting top outer layer comprises an inelastic thermoplastic material.

4. The image protecting conditioning roll of claim 2, wherein said base material of said polymer fibers is elastic.

5. The image protecting conditioning roll of claim 3, wherein said inelastic thermoplastic material is a polycarbonate.

6. The image protecting conditioning roll of claim 3, wherein said inelastic thermoplastic material is a polystyrene.

7. The image protecting conditioning roll of claim 3, wherein said inelastic thermoplastic material is a polyamide.

8. The image protecting conditioning roll of claim 3, wherein said inelastic thermoplastic material is a polyvinyl chloride.

* * * * *